US008145116B2

(12) United States Patent
Ferrar et al.

(10) Patent No.: US 8,145,116 B2
(45) **Date of Patent: *Mar. 27, 2012**

(54) ELECTROSTATOGRAPHIC APPARATUS HAVING IMPROVED TRANSPORT MEMBER

(75) Inventors: Wayne T. Ferrar, Fairport, NY (US); Francisco L. Ziegelmuller, Penfield, NY (US); Douglas E. Garman, Webster, NY (US); Dennis R. Fronheiser, Rochester, NY (US); Edward T. Miskinis, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 1246 days.

This patent is subject to a terminal disclaimer.

(21) Appl. No.: 11/842,235

(22) Filed: Aug. 21, 2007

(65) Prior Publication Data

US 2009/0052964 A1 Feb. 26, 2009

(51) Int. Cl.
*G03G 15/00* (2006.01)

(52) U.S. Cl. ..... 399/400; 399/328

(58) Field of Classification Search ..... 399/320, 399/322, 324, 400, 325, 327, 328
See application file for complete search history.

(56) References Cited

U.S. PATENT DOCUMENTS

| | | | | |
|---|---|---|---|---|
| 4,534,799 | A * | 8/1985 | Aguirre | 106/270 |
| 4,780,356 | A | 10/1988 | Otouma et al. | |
| 4,879,166 | A | 11/1989 | Misuda et al. | |
| 5,085,698 | A | 2/1992 | Ma et al. | |
| 5,157,445 | A | 10/1992 | Shoji et al. | |
| 5,406,364 | A | 4/1995 | Maeyama et al. | |
| 5,512,409 | A | 4/1996 | Henry et al. | |
| 5,605,750 | A | 2/1997 | Romano et al. | |
| 5,693,442 | A | 12/1997 | Weiss et al. | |
| 5,723,211 | A | 3/1998 | Romano et al. | |
| 5,903,802 | A | 5/1999 | Watanabe et al. | |
| 7,120,380 | B2 | 10/2006 | Ferrar et al. | |
| 7,769,338 | B2 * | 8/2010 | Ferrar et al. | 399/400 |
| 2005/0105939 | A1 * | 5/2005 | Ferrar et al. | 399/322 |
| 2006/0160002 | A1 * | 7/2006 | Qi et al. | 430/58.2 |
| 2006/0165974 | A1 | 7/2006 | Ferrar et al. | |
| 2007/0196151 | A1 | 8/2007 | Ferrar et al. | |
| 2008/0107463 | A1 | 5/2008 | Ferrar et al. | |

OTHER PUBLICATIONS

U.S. Appl. No. 11/359,068, filed Feb. 22, 2006, Ferrar, et al.
U.S. Appl. No. 11/557,838, filed Nov. 8, 2006, Ferrar, et al.

* cited by examiner

*Primary Examiner* — Judy Nguyen
*Assistant Examiner* — Shema Freeman
(74) *Attorney, Agent, or Firm* — Carl F. Ruoff; Andrew J. Anderson

(57) ABSTRACT

The present invention is an electrostatographic reproduction apparatus which includes a primary imaging member for producing an electrostatic latent image on a receiver, a development station for applying toner particles to said latent image which forms a developed toner image on the receiver. A fuser assembly is included for fixing the developed toner image, to form a fused toner image on the receiver. A transport member is provided for transporting the receiver to or from the fuser assembly, the transport member having a substrate bearing an oil-absorbing layer that includes transparent alumina inorganic particles of siloxane coated gamma-alumina, dispersed in an organic binder, and a fluorosurfactant.

20 Claims, 2 Drawing Sheets

ELECTROSTATOGRAPHIC APPARATUS HAVING IMPROVED TRANSPORT MEMBER

FIELD OF THE INVENTION

The present invention relates to electrostatographic image reproduction and, more particularly, to an electrostatographic apparatus that includes a transport web provided with a release oil-absorbing layer.

BACKGROUND OF THE INVENTION

Electrostatographic printers produce images by transferring polymeric toner particles from a photoreceptor to a receiver and fixing the toner particles to the receiver with heat and pressure. Various additives and oils are used to aid the transfer of the particles. Silicone oil is commonly used as a release oil because it is thermally stable and incompatible with the toner particles and other polymers in the printer; unfortunately, however, it tends to spread throughout the machine as prints are made. Release oil spread is exacerbated by duplex printing, which entails the application of images to both sides of a receiver sheet. Oil provided to the receiver during application of the first image on one side of a receiver is carried into the printer on the paper transport web in the course of applying the second image to the opposite side, leading to objectionable image artifacts such as non-uniform density and differences in gloss. Details of fuser oil application are given in U.S. Pat. Nos. 5,157,445 and 5,512,409, the disclosures of which are incorporated herein by reference.

Ink-jet printers produce images by ejecting droplets of ink onto receivers that absorb ink. Porous coatings of inorganic particles on the receivers improve the image quality by, for example, causing more rapid drying of the ink, reducing image spread, and producing more uniform ink coverage. Silica and alumina particles incorporated into binder polymers are used for coatings on paper and coatings on clear plastics such as polyethylene terephthalate sheets. While larger particles can be used to produce opaque coatings on paper substrates, smaller particles are required for coatings that are transparent in a binder, which is also desirably transparent and colorless. Microporous ink-jet recording elements prepared using psuedo-boehmite in organic polymer matrices are described in, for example, U.S. Pat. Nos. 5,723,211; 5,605,750; 5,085,698; 4,879,166; and 4,780,356, the disclosures of which are incorporated herein by reference.

Similar materials have also been used in electrophotography. U.S. Pat. No. 5,406,364 to Maeyama et al. describes a cleaner in the form of a web prepared by immersing a piece of non-woven fabric into a colloidal solution of alumina or silica sol. Poly(vinyl alcohol) may also be added. The patent teaches that porous particles can absorb release agent to clean contaminated surfaces in an electrophotographic apparatus. There is no mention of transparency, or reference to the size of the oxide particles. The web is used to remove silicone oil from the transfer drum. The coating is not subjected to repeated charging and discharging in the electrophotographic process and thus it does not have to possess insulating properties. Furthermore the material itself is not cleaned of toner from the electrophotographic process and, therefore, does not have to possess a low surface energy.

U.S. Pat. No. 5,903,802 to Watanabe uses pseudo-boehmite particles as well as silica particles, porous ceramics and foamed metals to clean transfer members and photoreceptors. Release agent absorbing layers are placed in various parts of the electrophotographic apparatus such as the feed passage member. Particle size is not important because there is no requirement for the layer to be transparent, nor is the coating subjected to repeated charging and discharging in the electrophotographic process. Furthermore the material itself is not cleaned of toner from the electrophotographic process and therefore does not have to possess a low surface energy.

Pseudo-boehmite coatings have also been applied to the photoreceptors used in electrophotographic printing. U.S. Pat. No. 5,693,442, the disclosure of which is incorporated herein by reference, describes the incorporation of a nickel metallized dye into an overcoat of pseudo-boehmite to act as a filter to protect the light sensitive element. The inorganic particles and 5 wt. % of the metallized dye in a poly(vinylpyrrolidone) binder form a transparent layer that can be charged under a corona charger and discharged by exposure to actinide radiation.

Pseudo-boehmite is disclosed as an oil absorbing layer that employs fluorinated surfactants as cleaning aids in U.S. Pat. No. 7,120,380 B2. Pseudo-boehmite is disclosed as in a transport member for an electrophotographic apparatus that displays high friction in U.S. Patent Application No. 2006/0165974. Pseudo-boehmite is disclosed as an oil absorbing layer that employs wax overcoats as cleaning aids in U.S. Publication No. 2007/0196151. Gamma-alumina is disclosed as an oil absorbing layer that employs siloxanes surfactants as cleaning aids in U.S. Pat. No. 7,769,338. All four of these applications are incorporated by reference into this application.

The mitigation of objectionable image artifacts such as non-uniform density and differences in gloss that result from the spread of release oil from an imaged receiver into the reproduction apparatus, particularly during a duplex printing process, is provided by the present invention.

SUMMARY OF THE INVENTION

The present invention is an electrostatographic reproduction apparatus which includes a primary imaging member for producing an electrostatic latent image, a development station for applying toner particles to said latent image which forms a developed toner image. A fuser assembly is included for fixing the developed toner image to a receiver, to form a fused toner image on the receiver. A transport member is provided for transporting the receiver to or from the fuser assembly, the transport member having a substrate bearing an oil-absorbing layer that includes transparent alumina inorganic particles of siloxane coated gamma-alumina, dispersed in an organic binder, and a fluorosurfactant.

For a better understanding of the present invention together with other advantages and capabilities thereof, reference is made to the following description and appended claims in connection with the preceding drawings.

DETAILED DESCRIPTION OF THE INVENTION

Figure 1:
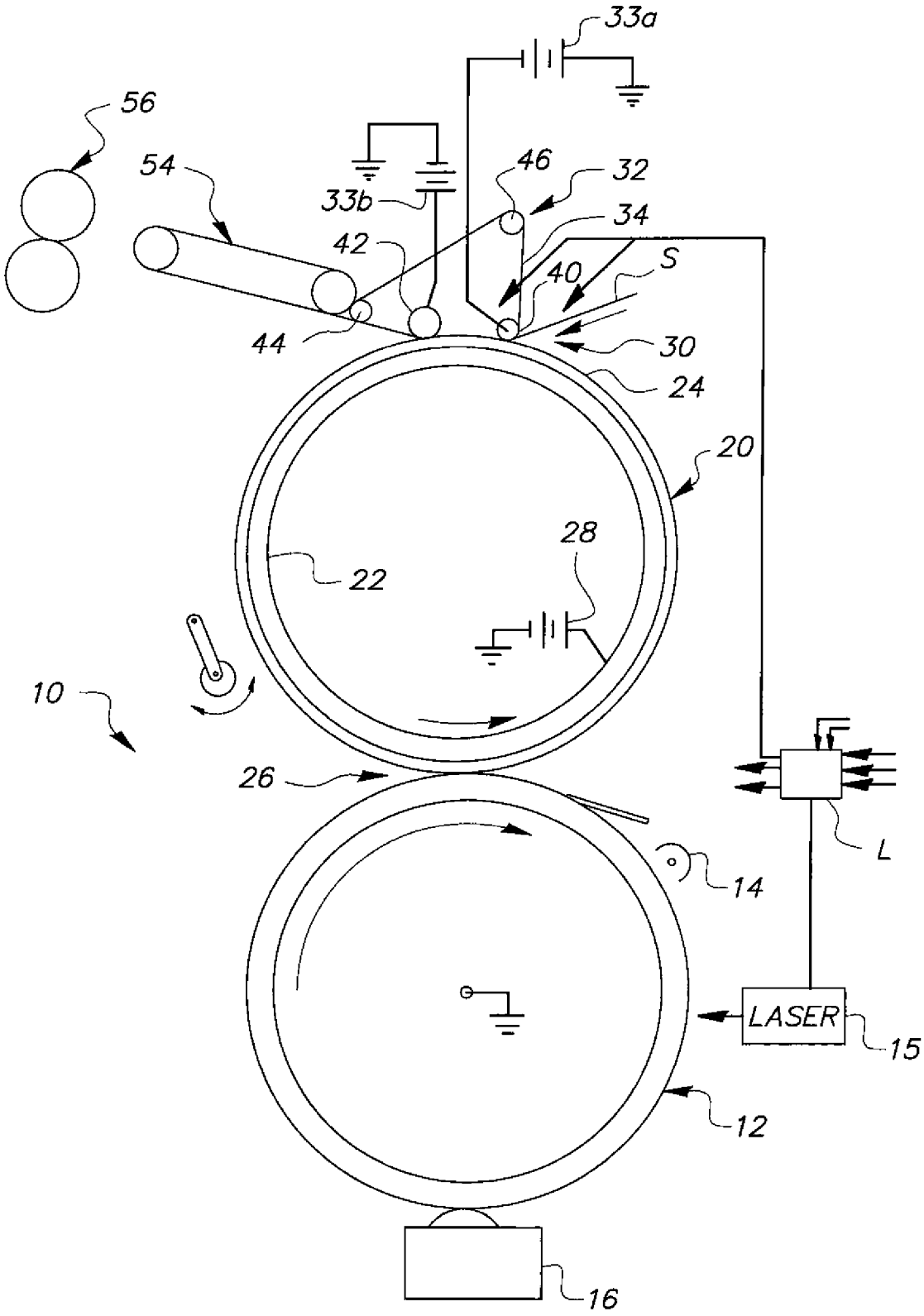
FIG. 1 is a schematic side elevational view of an electrostatographic reproduction apparatus that includes an endless web transport member for moving a receiver to and from a fuser assembly.

FIG. 1 shows an exemplary image-forming electrostatographic reproduction apparatus, designated generally by the numeral 10, that includes a primary image-forming member, for example, a drum 12 having a photoconductive surface, upon which a pigmented marking particle image, or a series of different color marking particle images, is formed. To form images, the outer surface of drum 12 is uniformly charged by a primary charger such as a corona charging device 14, and the uniformly charged surface is exposed by suitable exposure device such as a laser 15 to selectively alter the charge on the surface of the drum 12, thereby creating an electrostatic image corresponding to an image to be reproduced. The electrostatic image is developed by application of pigmented marking particles to the image bearing photoconductive drum 12 by a development station 16 that may include from one to four (or more) separate developing devices.

The marking particle image is transferred (or multiple marking particle images are transferred one after another in registration) to the outer surface of a secondary or intermediate image transfer member, for example, an intermediate transfer drum 20 that includes a metallic conductive core 22 and a compliant layer 24 that has relatively low resistivity. With such a relatively conductive intermediate image transfer member drum 20, transfer of the single color marking particle images to the surface of drum 20 can be accomplished with a relatively narrow nip 26 and a relatively modest potential applied by potential source 28.

A single marking particle image, or a multicolor image comprising multiple marking particle images respectively formed on the surface of the intermediate image transfer member drum 20, is transferred in a single step to a receiver S, which is fed into a nip 30 between intermediate image transfer member drum 20 and a transfer backing member 32. The receiver S is fed from a suitable receiver member supply (not shown) into nip 30, where it receives the marking particle image. Receiver S, exits nip 30 and is transported by a transport web 54 to a fuser assembly 56, where the marking particle image is fixed to receiver S by application of heat and/or pressure. Receiver member S bearing the fused image is transported by transport web 54 to a storage location (not shown) or is inverted by a mechanism (not shown) for transfer of a second image to the reverse side of receiver S.

A transfer-backing member 32 that includes an endless support 34 is entrained about a plurality of support members, for example rollers 40, 42, 44, and 46. Support roller 42 is electrically biased by potential source 33*b* to a level sufficient to efficiently urge transfer of marking particle images from intermediate image transfer member drum 20 to receiver member S. At the same time, support roller 40 is electrically biased, for example to ground potential, or electrically connected to source 28 or a separate potential source 33*a*, to a level sufficient to eliminate ionization and premature transfer upstream of nip 30.

Appropriate sensors (not shown) of any well known type are utilized in reproduction apparatus 10 to provide control signals for apparatus 10, which are fed as input information to a logic and control unit L that produces signals for controlling the timing operation of the various electrographic process stations.

To facilitate release of the fixed toner image from fuser assembly 56, a release agent such as silicone oil is applied to imaged receiver S by a mechanism such as depicted in FIG. 1 of the previously cited U.S. Pat. No. 5,157,445. As already noted, an excess of this oil can be carried to other parts of apparatus 10, especially in the course of duplex printing, resulting in objectionable image artifacts.

In accordance with the present invention, a transport member in an electrostatographic reproduction apparatus 10, depicted in FIG. 1, includes a release oil-absorbing layer disposed on a substrate. Although the transport member is exemplified as a continuous web 54 in FIG. 1, it may take other forms such as, for example, a drum or roller. Apparatus 10 further includes a primary image-forming member, which is exemplified in FIG. 1 as a drum 12 but may be constructed in another form such as, for example, a roller or a belt. The reproduction apparatus optionally includes, operationally associated with the primary image-forming member, an intermediate image transfer member, which is depicted in FIG. 1 as a drum 20 but may also be constructed in another form such as, for example, a roller or a belt.

A transport member provided with an oil-absorbing layer in accordance with the present invention may be included in a full color reproduction apparatus having four toner development stations for cyan, magenta, yellow, and black, as depicted in FIG. 8 of U.S. Pat. No. 6,075,965, the disclosure of which is incorporated herein by reference. A developed multicolor image, following fixing by a fuser assembly, can be transported to a storage site or circulated back for recording an image on the opposite side of the receiver, as described in U.S. Pat. No. 6,184,911, the disclosure of which is incorporated herein by reference.

Charge is repeatedly applied to the surface of the transport member in every imaging cycle at each of the transfer nips. The transport web is reconditioned in each cycle by providing charge to both surfaces by opposed corona chargers 522, 523 in FIG. 8 of U.S. Pat. No. 6,075,965. An additional corona charger 524 provides negative charge of approximately 600-900 V to tack down of the paper or receiver to the transport web thus preventing the receiver from moving as it goes through the electrophotographic process. After transfer of the toner image to the receiver, the receiver is conveyed on the transport web to a nip where an electrical bias is applied so the receiver can be detacked and fed into a fuser station. Additionally the web is imaged with various colored toners that are used for process control of image density and registration. Thus, it is important that the transport member have insulating properties that allow for efficient charging and for the maintenance of the charge throughout the electrophotographic cycle. If the resistivity of the transport member decreases due to high humidity, the image quality of the process is compromised. In general poly(ethylene terephthalate) is one of the preferred substrates for the transport member because it has a good insulating properties. It would be desirable that any coating on the transport member maintain similar insulating properties.

It is also important that the layer be transparent or translucent so that sensors for process control can be used to monitor toner density and image registration. These sensors can work by passing light through the coated transport web to a detector on the opposite side or by reflecting the light back to a detector mounted above the sensor. The light may be reflected by a separate reflector after the light has passed through the web, or by the support itself.

Previous inventions for release oil absorbing layers employed pseudo-boehmite particles. Pseudo-boehmite is a xerogel of boehmite and is represented by the chemical formula Al(O)OH. It is a crystalline solid with the boehmite X-ray diffraction pattern. Pseudo-boehmite is a highly hydrated form of alumina and contains a large amount of water, which makes it a poor electrical insulator. It is easily dispersed in water from which it can be coated onto a support with poly(vinyl alcohol) as a binder.

A more condensed form of pseudo-boehmite is gamma-alumina. Gamma-alumina is a crystalline phase of aluminum oxide that can be prepared by heating pseudo-boehmite to 500-550° C. for three hours. It is used as a filler particle in silicone polymers and as a catalyst for petroleum refining and in automobile catalytic converters. In this invention we incorporate gamma-alumina into a transparent layer to absorb silicone release fluid in a electrophotographic printer where the release fluid comes from the fuser. The gamma-alumina can be dispersed in organic solvents by milling techniques and coated with binder polymers such as poly(vinyl butyral) onto various supports. These coatings have the advantage over porous layers made from using pseudo-boehmite particles because they display a higher electrical resistivity, even at high humidity. The transparent, porous coatings made with the gamma-alumina will thus hold a charge that is deposited by a corona or roller charger for a longer period of time, allowing for improved tackdown of an electrophotographic receiver and more efficient transfer of toner particles for imaging. Additionally, these porous coatings with the gamma-alumina and an organic binder can be overcoated with wax that melts below 100° C. to produce a layer that has lower surface energy for removal of toner during cleaning. We also show below that the gamma-alumina particles and coatings can be modified with poly(siloxanes) to further increase the resistivity to allow for better receiver tack down and facilitate toner removal after the charge is removed from the coating.

The gamma-alumina inorganic particles are represented by the chemical formula $Al_2O_3$. Literature reference to gamma-alumina include K. Sohlberg, S. J. Pennycook, and S. T. Pantelides, J. Am. Chem. Soc. 1999, 121, 7493-7499 and J. Temuujin, T s Jadambaa, K. J. K. MacKenzie, P. Angerrer, F. Porte, and F. Riley, Bull. Mater. Sci, Vol. 23, No. 4, August 2000, pp [301-304. The pore characteristics of the gamma-alumina vary depending upon the size and shape of the particles. The particle size is determined by the effectiveness of breaking up the agglomerates to form the primary particle size. Calcining of a pseudo-boehmite particle at 500° C. for 3 hours forms gamma-alumina crystallites that are smaller in size but have higher pore volumes than the pseudo-boehmite precursors. Larger particles scatter light to various degrees and thus it is an advantage to use a smaller particle that also produces high porosity coatings. Comparing gamma-alumina particles, smaller particles have smaller pores than the larger particles and tend to be transparent. Smaller particles with a dispersed particle size of less than 0.5 micron are used for this invention so the porous layers are transparent or translucent. More preferably, the dispersed particle size is less than 0.3 microns. Most preferably, the dispersed particle size is about 0.25 microns.

Many variations of the gamma-alumina structure are known. The alumina may be doped with various levels of lanthanum, cerium, zirconium, titanium, tungsten, neodymium, silicon, and magnesium oxides. More than one dopant may be present in the gamma-alumina crystal. Mixed silica-alumina particles have been prepared covering all compositions of the two elements, from small amounts of silica to silica rich materials. The acidic properties of these materials is compared to zeolites in a paper by W. Daniell, U. Schubert, R. Glockler, A. Meyer, K. Noweck, and H. Knozinger, Applied Catalysis A: General 196 (2000) 247-260. One source of these particles is Sasol and they are sold by the trade name SIRAL.

Gamma-alumina is a better insulator than pseudo-boehmite. Calcining the particles from the pseudo-boehmite form to the gamma-alumina form drives off much of the water within the pseudo-boehmite structure. Psuedo-boehmite has a formula of AlO(OH), reflecting a high water content, while gamma-alumina can be more closely represented by the general alumina formula of $Al_2O_3$. High purity of the gamma-alumina is also important to achieve good resistivity of the oil absorbing layer, which can be reflected in the process used to make the pseudo-boehmite. Gamma-alumina also has higher porosity than pseudo-boehmite. Thus coatings can be thinner, using less material and causing less stress in the coating that could result in cracking and delamination. Coating made with 10 microns of gamma-alumina/poly(vinyl butyral) absorb about the same amount of silicone release fluid as 20 micron coatings of pseudo-boehmite/polyvinyl alcohol (PVA).

An organic binder is employed in the oil-absorbing layer to impart mechanical strength to it. The pore characteristics and transparency of the oil-absorbing layer depend on the particular binder employed. Suitable binders include organic materials such as, for example, starch or one of its modified products, poly(vinyl alcohol) or one of its modified products, cellulose derivatives, ether-substituted poly(phosphazenes), ether-substituted acrylates, ethylene oxide-vinyl alcohol copolymers, poly(vinyl butyral) (PVB), poly(vinyl formal), polyoxazolines, aliphatic polyamides, and poly(vinylpyrrolidone). A major factor in the choice of the binder is that it is compatible with porous alumina particles and results in a transparent or translucent layer. The binder, preferably poly (vinyl butyral), is present in an amount, based on the amount of inorganic particles, of preferably about 3 wt. % to about 30 wt. %, more preferably, about 5 wt. % to about 25 wt. %. If the amount of binder is less than about 3 wt. %, the strength of the oil-absorbing layer tends to be inadequate. On the other hand, if it exceeds 30 wt. %, its porosity tends to be inadequate. Coatings made of the dispersed gamma-alumina of less than 0.5 micron dispersed particle size on transparent substrates are clear to translucent, and therefore allow for the process control sensors to operate effectively. Poly(vinyl butyral) has fewer hydroxyl groups on the polymer than poly(vinyl alcohol) because they have been substituted with a butyl group, making the polymer less polar. In general, poly(vinyl butyral)s are soluble in alcohol and organic solvents but are insoluble in water.

The coatings prepared with gamma-alumina are inherently more insulting than those made with pseudo-boehmite. As discussed above, the gamma-alumina particles are inherently more resistive than the pseudo-boehmite particles. Correspondingly gamma-alumina sols are prepared by milling in organic solvents such as ethanol or 1-methyl-2-propanone, but unlike pseudo-boehmite they are not water dispersible. Poly(vinyl butyrals) are soluble in organic solvents and we have found that these binders generally stabilize the gamma-alumina sols in ethanol or 3A alcohol to allow for transparent coatings. The coatings have resistivities approaching $10^{12}$ ohm/sq at 70° F./60% RH, which is approximately 2 orders of magnitude more resistive than similar coatings made with pseudo-boehmite and poly(vinyl alcohol) coated from water. It is preferable to have coated transport webs made with gamma-alumina and poly(vinyl butyral) that have resistivities with a minimum surface resistivity equal to or greater than $1\times10^{11}$ ohm/sq at 70° F./60% RH.

The release oil-absorbing layer of the present invention preferably has a dried thickness of about 1 μm to about 40 μm, more preferably, about 2 μM to about 30 μm, and most preferably between 4 and 20 μm. The release oil absorbing layers of gamma-alumina/PVB are more efficient than the pseudo-boehmite/PVA layers of the previous work, allowing for thinner layers to absorb the same amount of oil. This is possible because of a significant improvement in the oil absorption capacity when compared to pseudo-boehmite/PVA layers. Optionally, the oil-absorbing layer can also incorporate various known additives, including surfactants, pH controllers, anti-foaming agents, lubricants, preservatives, viscosity modifiers, waterproofing agents, dispersing agents, UV absorbing agents, mildew-proofing agents, mordants, crosslinking agents such as boric acid or borax, and the like, with the proviso that the additive does not greatly decrease resistivity or the transparency of the layer. The oil-absorbing layer can also include matting agents such as matte beads comprising crosslinked polystyrene, crosslinked polyacrylate, or polytetrafluoroethylene (TEFLON) and having a diameter preferably between about 1 μm and about 30 μm, more preferably between about 2 μm and about 10 μm.

A web substrate for the oil-absorbing layer can be reflective, translucent, or transparent and can have a thickness of, preferably about 50 μm to about 500 μm, more preferably, about 75 μm to about 300 μm. The web substrate must either allow light to pass through or be reflective. Poly(ethylene terephthalate) (PET) is a preferred substrate. Other clear semi-crystalline substrates such as poly(ethylene naphthalate) (PEN) are also thought to be useful. Antioxidants, antistatic agents, plasticizers, and other known additives may be optionally incorporated in the web substrate.

The adhesion of the oil-absorbing layer to the substrate can be improved by corona-discharge treatment of the substrate surface prior to application of the oil-absorbing layer. Alternatively, an undercoating or subbing layer formed from a halogenated phenol or a partially hydrolyzed vinyl chloride-vinyl acetate copolymer and having a thickness (i.e. a dry coat thickness) preferably of less than 2 μm can be applied to the surface of the substrate.

Optionally, an additional backing layer or coating may be applied to the backside of the web substrate, i.e., the side of the substrate opposite the side bearing the oil-absorbing layer, to improve the machine-handling properties of the transport web and controlling the friction and resistivity thereof. Typically, the backing layer includes a binder and a filler, which can be, for example, amorphous and crystalline silicas, poly (methylmethacrylate), hollow sphere polystyrene beads, microcrystalline cellulose, zinc oxide, talc and the like. The filler included in the backing layer is generally less than 2 wt. % of the binder, and the average particle size of the filler material is in the range of 5 μm to 15 μm. Typical of the binders used in the backing layer are polymeric materials such as gelatin, chitosan, acrylates, methacrylates, polystyrenes, acrylamides, poly(vinyl alcohol), poly(vinylpyrrolidone), poly(vinyl chloride)-co-poly(vinylacetate), SBR latex, NBR latex, and cellulose derivatives.

To form the release oil-absorbing layer on a substrate, a binder is added to the inorganic particles to obtain a slurry, which is coated on the substrate using, for example, a roll coater, an air knife coater, a blade coater, a rod coater, a bar coater, or a comma coater, and then dried. Preferred coating compositions for the oil-absorbing layer contain gamma-alumina and poly(vinyl butyral) in a weight ratio of about 3:1 to about 20:1.

The present invention also provides a method to eliminate slippage of the intermediate transfer drum against the transport web and thus provides for improved registration of a composite image. However it is not meant to limit these improvements only to these elements in an electrostatographic printer, and could include suppression of slippage between a photoreceptor drum or belt. According to this invention, a frictionally driven electrostatographic reproduction apparatus has a receiver member transport web element that is frictionally coupled with each module that produces a toned color separation image, preferably a dry toned image, and a fuser assembly with a fuser release agent for fixing developed toner images to form a fused toner image on a receiver member. The receiver member transport web is formed so as to include a substrate and a layer that contains inorganic particles of gamma-alumina dispersed in an organic binder to form a porous layer. A previous U.S. patent application Ser. No. 11/359,067 described the inorganic particles as pseudo-boehmite, an agglomerated crystalline inorganic sub-oxide that takes the form of plates and needles. Another U.S. patent application Ser. No. 11/557,838 extended those advantages from the previous invention, with all of the added benefits of the transparent coating obtained from gamma-alumina/poly(vinyl butyral), including higher resistivity and higher oil absorption. This invention extends those advantages from the previous invention, with all of the added benefits of the transparent coating obtained from gamma-alumina/poly(vinyl butyral)/siloxane/fluorosurfactant, including higher resistivity and better cleaning of toner from the porous layer surface.

Figure 2:
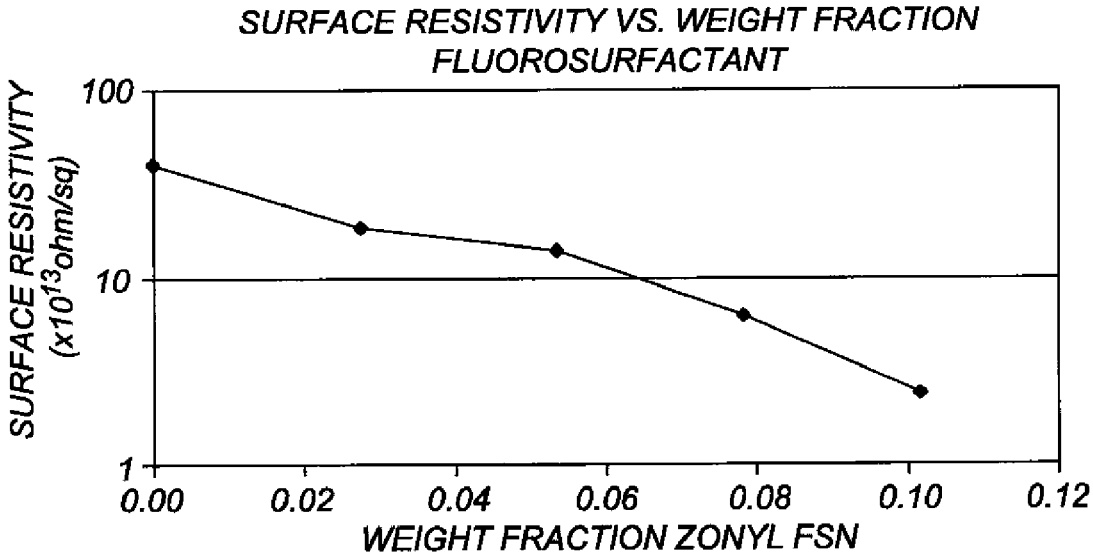
FIG. 2 is a graph of the decrease of surface resistivity with increasing level of fluorosurfactant ZONYL FSN. The surface resistivity is greater than $10^{13}$ ohm/sq for ZONYL FSN levels up to 10 wt % of the porous overcoat. The coated transport webs readily cleaned at higher levels of ZONYL FSN.

Siloxane polymers are useful to increase the resistivity of the gamma-alumina/poly(vinyl butyral) oil absorbing layer, and also act as lubricants that make cleaning of the layer more efficient. In general low molecular weight PDMS will make the layer substantially more resistive, to the point where it is similar to the PET substrate. For example, 10 micron coatings have been prepared with surface resistivities between $10^{13}$ and $10^{15}$ ohm/sq at 70° F./60% RH. This results in an important advantage of good paper or receiver tack down, even after several minutes of machine stoppage. The stable electrical properties of the gamma-alumina with the poly(vinyl butyral) binder and PDMS is depicted in FIG. 2 of U.S. patent application Ser. No. 11/557,838. It is most preferable to have coated transport webs made with gamma-alumina, poly(vinyl butyral), and PDMS that have resistivities with a minimum resistivity equal to or greater than $1\times10^{13}$ ohm/sq at 70° F./60% RH.

It is also possible to generate PDMS polymers in-situ by adding alkoxysilanes to the coating solution. The addition of dimethoxydimethylsilane (DMDMS) to the ethanol coating solution leads to the formation of siloxane segments in the coating that also increase the resistivity and improve the cleaning properties.

At low humidity the porous layer is dry and has high resistivity. This allows for easy charging of the transport web and results in good paper tack down and good image registration and process control from imaging on the transport web.

Fluorosurfactants are useful as cleaning aids for inclusion in the oil-absorbing layers, serving to facilitate the removal of toner particles from the surface of the coated substrate as described in U.S. Pat. No. 7,120,380 and U.S. Patent Application No. U.S. 2006/0165974. The addition of the fluorosurfactant ZONYL FSN, a water-soluble, ethoxylated nonionic fluorosurfactant, to the oil-absorbing layer enables the removal of toner particles that are not readily removed in the absence of the surfactant. The oil-absorbing layer includes the fluorosurfactant preferably in an amount of about 0.01 wt. % to about 15 wt. %, more preferably, about 0.02 wt. % to about 12 wt. %, of the total amount of inorganic particles and organic binder.

Like most surfactants that are intended for aqueous applications, ZONYL FSN consists of about half a hydrophobic tail and half a hydrophilic portion. The hydrophobic portion consists of a short fluorocarbon chain $C_nF_{2n+1}$. The hydrophilic portion consists of an ethylene glycol chain $(C_2H_4O)_m$. The pure material is a greasy, tan solid with a melting point of 30° C. that is typically at levels of 0.01 to 0.1% by weight when used as a surfactant coating aid. However in this invention the ZONYL FSN serves as a lubricant to assist the polyurethane blade in cleaning of the toner from the surface of the transport web. Optimal properties are obtained when the ZONYL FSN is added at 9 parts by weight to the gamma-alumina/poly(vinyl butyral) (90/10) parts by weight in the layer, when 6 parts by weight siloxane is included. This corresponds to 7.8 weight % ZONYL FSN in the porous layer. Alternatively, the ZONYL FSN can be overcoated onto the porous alumina layer.

Some of the previous inventions described the addition of the fluorosurfactant ZONYL FSN to aid in cleaning of toner from the transport web surface. However, ZONYL FSN is composed from ethylene glycol with a fluorocarbon, and when this surfactant is combined with pseudo-boehmite and poly(vinyl alcohol), the resistivity of the coating has been found to decrease especially at high humidity. This results in a number of undesirable properties such as poor tack down of the paper or receiver to the transport web because the conductive ZONYL FSN surfactant provides a pathway for the charge to dissipate. The charge was deliberately place on the web by the web charger in order to hold the receiver in place and allow for imaging with toner for process control purposes and an image with poor quality can result from the charge dissipation. Although the resistivity of the web also decreases when added to the gamma-alumina/PVB/siloxane porous layer, the loss of resistivity is not as great as with the pseudo-boehmite based materials.

WE waxes are fatty acid esters formed from long chain fatty acid and alcohols produced by NOF Corporation of Japan. They are high purity solids characterized by narrow melting ranges, low endothermic energy for melting, and high thermostability. The waxes that melt below 100° C. do not block the pores of the gamma-alumina. However the WE waxes are not useful for this invention. The siloxane coating on the gamma-alumina prevent wetting of the film surface with the higher surface energy WE waxes. Addition of the waxes to the alumina dispersion or coating the wax over the alumina in a separate layer resulted in poor coatings that are not suitable for the purposes of this invention. We found that overcoating layers that incorporated 10 wt % PDMS with WE waxes resulted in spotty coatings of wax.

It is particularly advantageous to add the siloxane to the coating solution before it is milled. This results in a uniform distribution of the siloxane and good coating quality. Silanol terminated PDMS appears to be particularly useful to prepare good coating, possibly because the silanol groups interact or even condense on the surface of the gamma-alumina. The level of PDMS can be relatively high, with concentrations greater than 10 wt % of the coating solid. But it is even more surprising that the pore volume of the coated layer as measured by oil uptake of fuser oil can increase when PDMS is added to the formulation. In contrast, the addition of fluorosurfactants such as ZONYL FSN causes the oil absorption volume to decrease. The PDMS also aids in cleaning of the coating of toner that is deposited during color and receiver registration as part of the electrophotographic process control.

Measurement of the surface resistivity of the porous layer gives a good indication of how well the coated transport webs will hold a charge. The surface resistivity can be measured using a Keithley electrometer. A 10 micron thick coating of the gamma-alumina/poly(vinyl butyral) over the PET transport web had surface resistivity in the $10^{12}$ ohm/sq range that did not change more than an order of magnitude between 20-60% RH. Thus these coatings are approximately two order of magnitude more resistive than comparable pseudo-boehmite/PVA oil absorbing layers. Coatings over the PET transport web made with the addition of the fluorosurfactant ZONYL FSN to gamma-alumina/poly(vinyl-butyral) became slightly less resistive. A coating with 6 parts ZONYL FSN had a surface resistivity at 60% RH of $1\times10^{12}$ ohm/sq and a coating with 12 parts ZONYL FSN had a surface resistivity of $6\times10^{11}$ ohm/sq. Nonetheless, these values are about a two order of magnitude higher than those same coating using pseudo-boehmite in place of the gamma-alumina.

The addition of fluorosurfactants such as ZONYL FSN to formulations of gamma-alumina does not cause as large a decrease in resistivity as observed with pseudo-boehmite. Although this is not fully understood, it probably is related to the lower water component of the gamma-alumina compared to the pseudo-boehmite. Additionally, the siloxane coatings on the alumina particles further helps to prevent water uptake of the coating, and mitigates the increase in conductivity that is observed with the pseudo-boehmite/ZONYL FSN coatings. FIG. 2 is a graph of the increase of surface resistivity with increasing level of fluorosurfactant ZONYL FSN when to a formulation of 90 parts gamma-alumina/10 parts PVB/6 parts PDMS. The surface resistivity is greater than $10^{13}$ ohm/sq for ZONYL FSN levels up to 12 parts (10 wt %) of the porous overcoat. The coated transport webs readily cleaned. The surface resistivity decreased logarithmically in this region of ZONYL FSN concentration, but did not fall below $10^{13}$ ohm/sq. The optimum cleaning was obtained in Example 3, where the coated transport web with 9 parts (7.83 wt %) of ZONYL FSN had a surface resistivity of $6\times10^{13}$ ohm/sq.

These values are not as high in resistivity as obtained when first coating the gamma-alumina with PDMS. As reported in the previous application, addition of up to 10 wt % of silanol terminated poly(dimethylsiloxane) further increases the resistivity of the film into the $10^{14}$ ohm/sq range. In fact, these films are such good insulators that the resistivity readings are comparable to those obtained for PET, and are probably approaching the limit of the range measurable with the Keithley electrometer. Receiver tack-down to the gamma-alumina/PDMS coated web was almost as good as with the uncoated PET web, which corresponds to the high resistivity value for these materials. We now find that addition of ZONYL FSN to the gamma-alumina/poly(vinyl butyral)/siloxane improves toner removal from the surface of the film without seriously lowering the resistivity of the coating. These coatings have surface resistivities greater than $5\times10^{12}$ ohm/sq, and in most cases in the $10^{13}$ and $10^{14}$ ohm/sq range for loadings of up to 12 parts ZONYL FSN. The fluorosurfactants are compatible with the other components of the coating and can be added directly to the coating solution in 3A alcohol.

Siloxanes are also useful as overcoats for the oil absorbing layer if the fluorosurfactant is not present in the coating. They provide another layer of protection against moisture that might lower the resistivity at high relative humidity, and they help facilitate cleaning of toner by the cleaning blade. The siloxanes lower the surface energy of the alumina layer and act as lubricants. The siloxane overcoats do not interfere with oil absorption, nor do they cause image artifacts on prints from the electrophotographic printers. They can be coated from a number of environmentally acceptable solvents. We have shown previously that ethanol can be used to form an overcoat of low molecular weight silanol terminated PDMS, viscosity of 20-35 centistokes. Higher molecular weight PDMS of 10,000 centistoke and without hydroxyl groups can be prepared from 2-butanone. Surface resistivities as high as $10^{15}$ ohm/sq at 60% RH have been obtained in the films with high amounts of PDMS. However, attempts to use 100,000 centistoke PDMS resulted in slippage of the transport web in the printer, probably due to transfer of the PDMS to the back surface when the web was rolled upon itself. An inherent disadvantage to using an overcoat is an additional coating step is required that makes the coating process more complex and adds to the expense. However an overcoat allows a layer to be specifically designed for properties such as wear and cleaning of the webs, as long as the overcoat is transparent and porous enough to allow the release oil to pass through to the oil absorbing alumina layers below. Unfortunately coating solutions of PDMS tend to fowl the coating machine for subsequent coatings. The PDMS can change the properties of the surfaces of the coating rollers and cause undesirable coating artifacts in the next set of coatings. Cleaning siloxanes used in the overcoat from the coating rollers of a coating machine after the job is complete can require lengthy, difficult washing procedures with organic solvents that can make preparing such films prohibitively expensive. Siloxanes are liquids that spread readily on contact to other surfaces due to the low surface energy. They are notoriously difficult to contain.

Overcoats of fluorosurfactants have many of the same advantages as siloxane overcoats without the disadvantage of contamination of surrounding surfaces. In contrast to the liquid nature of the PDMS materials, fluorosurfactants tend to be waxy solids. They do not fowl the coating machine when coated as a separate layer, and are easier to clean from the coating roller due to the solubility in aqueous alcohols instead to organic solvents as for the siloxanes. They also do not flow to cover all surfaces due to the solid nature of the alkeneoxy-fluorocarbon. We have found that the addition of fluorosurfactant to siloxane coated gamma-alumina particles in a PVB binder resulted in improved cleaning of the porous layer without severe degradation of the resistivity. Because the fluorocarbon is more surface active than the siloxane, the material migrates to the top of the coating during drying. This further assists in the cleaning of the film by removing toner that is placed on the film for process control and color registration during electrophotographic printing.

Optionally, the fluorocarbon can be overcoated from an appropriate solvent such as aqueous alcohol to more completely cover the surface of the coating. Good results have been obtained by diluting the ZONYL FSN with either alcohol or water. This has several advantages including the use of less fluorocarbon in the base layers of the alumina, as the fluorocarbon is placed only where it is needed. This uses less fluorosurfactant which has both environmental and economic advantages. Further the oil absorption of the film is generally higher if the alumina pores are not filled with excess fluorosurfactant throughout the layers. Lower levels of fluorosurfactant also result in higher resistivity of the porous coating. Another option is to coat a thin overcoat of alumina, siloxane, binder and the fluorocarbon at a higher level than what is in the base coat. For example a layer containing as much as 30% of the fluorosurfactant can be used as a top layer of the coated web. Thus the top layer can serve as a reservoir of the fluorocarbon, leaving the lower layers free to hold more release oil.

When printing duplex images on certain described reproduction apparatus, release oil that had been applied to an imaged receiver transfers to the transport web from sheets that are to be printed on the second side. Comparison measurements of oil concentrations as a function of duplex run lengths have been carried out on standard uncoated paper transport webs and on webs provided with an oil-absorbing layer in accordance with the present invention. The oil-absorbing coating provides protection from release oil artifacts by drawing release oil into the porous interior of the coating, reducing the amount of release oil available at the surface for transfer to other parts of the machine. On the basis of this mechanism, the useful life of a web would depend on the oil capacity of the coating, which would be expected to depend on the coating thickness. The effective lifetime of a coating can be predicted based on its estimated capacity and the measured oil take up rate. A gamma-alumina/poly(vinyl butyral)/PDMS/fluorosurfactant transport web of this invention provided protection against oil streaks on image flat field after almost 30,000 A4 equivalent prints. The web was still functioning when it was removed. Previous experiments with pseudo-boehmite showed the experiment could have continued much longer. An uncoated web shows the fuser oil stripe signature after 18 prints.

In conclusion, important properties of the gamma-alumina/poly(vinyl butyral)/siloxane/fluorosurfactant transport webs include:

High resistivity to prevent charge from bleeding from the surface and decreasing the tackdown force of the receiver to the web ($>5\times10^{12}$ ohms/sq).

High porosity for the absorption of the fuser fluid release oil from the receiver to prevent the fluid from spreading to other components and causing image artifacts (200 to 600 $mg/m^2/\mu m$).

Good mechanical properties that produce long life coatings with no powder or dusting.

Improved registration of a composite image by the elimination of slippage of the intermediate transport drum against the transport web.

Good surface properties that allow for easy removal of toner deposited during electrophotographic registration.

Ease of manufacturability because fluororsurfactants do not contaminate the coating machine that is used to apply the waxy solid.

The present invention is further illustrated by the following examples, but it should be understood that the invention is not in any way restricted to such examples.

EXAMPLES

Pseudo-boehmite particles were obtained from Sasol North America, Inc of Houston, Tex. under the trade name of DISPAL 18N4-80. The particles had a dispersed particle size is reported to be 110 nanometers. Gamma-alumina powder was obtained from Sasol North America under the trade name CATALOX 18HTa-150 alumina and had a surface area or 150 $m^2/g$ and a pore volume of 0.446 cc/g.

A general procedure for the coating formulation is described here. The gamma-alumina was roll milled in 3A-alcohol at 20% solids for 5 days using 2 micron zirconia or 1.8 micron yttria doped zirconia beads. The beads were filtered off using a stainless steel screen and the alumina dispersion filtered using a 40 micron PALL filter. The poly(vinyl butyral) binder and silanol terminated poly(dimthysiloxane) was added to the dispersion before placing it through a Netzsch LabStar LS1 superfine grinding mill employing 1.0 micron yttria doped zirconia beads as the grinding material. Typically 1 liter of solution at 14% solids was milled for 1 hour. Additional binder or siloxane was sometimes added, and the dispersion filtered through a 10 micron PALL filter. The silanol terminated poly(dimethylsiloxane) was DMS-S12, molecular weight from 400-700, viscosity 16-32 centistoke, from Gelest, Inc., Tullytown, Pa., USA. Poly(vinyl butyral) was BH-6 ($9.2\times10^4$ molecular weight; 69+/−3 mole % butyral content) was obtained from Sekisui Products LLC, Troy, Mich. Dimethoxydimethylsilane (DMDMS) was obtained from Sigma-Aldrich, Milwaukee, Wis. BYK-333 is silicone surface additive available from BYK-Chemie GmbH.

The white gamma-alumina dispersion was coated, using an extrusion hopper, over a subbing layer of acrylonitrile-vinyl chloride-acrylic acid on one side of a 102 μm-thick polyethylene terephthalate film and dried at temperatures up to 220° C. for 20-30 minutes. The coatings were flexible, clear, transparent films that were formed into loops by ultrasonic sealing using with the coating on the outside of the loop.

Comparative Example 1

Pseudo-Boehmite/PVA/ZONYL FSN

The preparation of this pseudo-boehmite/poly(vinyl alcohol) (PVA) (9/1) coating and 6 parts ZONYL FSN was prepared as follows. A 25 wt. % pseudo-boehmite dispersion was prepared by addition of 90 g of DISPAL 18N4-80 alumina particles to 270 g of stirred deionized water. A 10 wt. % poly(vinyl alcohol) solution was prepared in a ratio of 10 g poly(vinyl alcohol) powder (KH-20 GOHSENOL, Nippon Gohsei) to 90 g stirred deionized water, and heating the mixture to 80° C. for 1 hour to produce a clear, viscous solution. The solutions were mixed and the appropriate amount of ZONYL FSN fluorosurfactant (40 wt. % active in isopropanol/water) at 6 parts by weight of the solid (5.7 wt. %). The final formulation consisted of 90 g boehmite, 10 g PVA, and 6 g ZONYL FSN.

Comparative Example 2

Gamma-Alumina/PVB/Siloxane/DMDMS

Gamma-alumina (400 g), 3 A alcohol (1000 g), and 2.0 mm zirconia beads (5000 g) were placed in a 1 gallon jar and roll milled for 48 hours at 90 RPM. The alumina was collected by filtering off the shot and rinsing with 3A-alcohol (1400 g) to give a 14.3% solids dispersion. This dispersion was filtered though a 40 micron PALL filter to give a total of approximately 2800 g. Ten batches of alumina dispersion were prepared in this way. A 22 liter 3 neck round bottom flask fitted with a mechanical stirrer and charged with 21,000 g of alumina dispersion. Poly(vinyl butyral) BH-6 (3337 g of a 10 wt % solution in 3A-alcohol) was added with an addition funnel to give a formulation with 10 wt % poly(vinyl butyral). Silanol-terminated PDMS, DMS-S12 (200.2 g), was added at 6% by weight of the total alumina and BH-6 solids to give a dispersion of 13.7% solids. The dispersion was Netsch milled for 25 minutes for each liter of solution for a total of 751 minutes, followed by filtration through a 10 micron PALL filter. Dimethoxydimethylsilane (DMDMS) (100.1 g) was added dropwise to the stirred dispersion, which was 3% by weight of the total alumina and BH-6.

Comparative Example 3

A NexPress transport web made of 4 mil PET.

Example 1-4, Comparative Examples 4-7

General Alumina Dispersion 90 Parts Gamma-Alumina/10 Parts Poly(Vinyl Butyral) Binder/6 Parts Silanol Terminated PDMS Gamma-alumina (400 g), 3 A alcohol (1000 g), and 2.0 mm zirconia beads (5000 g) were placed in a 1 gallon jar and roll milled for 48 hours at 90 RPM. The alumina was collected by filtering off the shot and rinsing with 3A-alcohol (1400 g) to give a 14.3% solids dispersion that was filtered though a 40 micron PALL filter to give a total of 2800 g. Ten batches of alumina dispersion were prepared in this way. A 22 L 3 neck round bottom flask fitted with a mechanical stirrer was then charged with 14005 g of alumina dispersion. Poly(vinyl butyral) BH-6 (2225 g of a 10 wt % solution in 3A-alcohol) was added with an addition funnel to give a formulation with 10 wt % poly(vinyl butyral). Silanol-terminated PDMS, DMS-S12 (133.5 g), was added at 6% by weight of the total alumina and BH-6 solids to give a dispersion of 13.7% solids. The dispersion was Netzsch milled for 25 minutes for each liter of solution for a total of 501 minutes, followed by filtration through a 10 micron PALL filter.

Example 1

3% ZONYL FSN by weight of the total alumina and BH-6. ZONYL FSN (2.38 g@40% active) was added to a stirred dispersion of the above General Alumina Dispersion (233.7 g).

Example 2

6% ZONYL FSN by weight of the total alumina and BH-6. ZONYL FSN (4.77 g@40% active) was added to a stirred dispersion of the above General Alumina Dispersion (233.7 g).

Example 3

9% ZONYL FSN by weight of the total alumina and BH-6. ZONYL FSN (7.15 g@40% active) was added to a stirred dispersion of the above General Alumina Dispersion (233.7 g).

Example 4

12% ZONYL FSN by weight of the total alumina and BH-6. ZONYL FSN (9.53 g@40% active) was added to a stirred dispersion of the above General Alumina Dispersion (233.7 g).

Comparative Example 4

6% dimethoxydimethylsilane by weight of the total alumina and BH-6 Dimethoxydimethylsilane (1.91 g) was added to a stirred dispersion of the above General Alumina Dispersion (233.7 g).

Comparative Example 5

6% BYK-333 by weight of the total alumina and BH-6. BYK-333 (1.91 g) was added to a stirred dispersion of the above General Alumina Dispersion (233.7 g).

Comparative Example 6

3% Dimethoxydimethylsilane and 6% ZONYL FSN by weight of the total alumina and BH-6. Dimethoxydimethylsilane (0.95 g) and ZONYL FSN (4.77 g@40% active) were added to a stirred dispersion of the above General Alumina Dispersion (233.7 g).

Comparative Example 7

3% BYK-333 and 6% ZONYL FSN by weight of the total alumina and BH-6. BYK-333 (0.95 g) and ZONYL FSN (4.77 g@40% active) were added to a stirred dispersion of the above General Alumina Dispersion (233.7 g).

Table 1 shows these films had good oil capacity and resistivity for a coated transport web. Coating thickness was determined by cross-sections using optical microscopy. Surface resistivity was measured using a Keithley 6517 Electrometer/High Resistance System and Keithley 8009 Resistance Test Fixture. The sample were kept at constant temperature and humidity overnight in a Tenney Six Chamber and each sample removed separately immediately before testing. The samples were approximately 7×7 cm squares. Oil absorbing was measured gravimetrically using 10×10 cm coatings on the PET. The sample weight was recorded to the fourth decimal point. An excess of NexPress fuser oil was placed on the sample using a stainless steel roller had been dipped into the oil. Care was taken not to get oil on the back of the sample. The samples generally become optically clear as the oil penetrates the coating. After 10 min, excess oil was removed from the sample using 3M High Performance Cloth 5208-W and the sample was weighed again. The difference in the weight is reported as the oil capacity.

Table 2 shows that blade cleaning of the toner improved with higher ZONYL FSN content when tested under the stress cleaning condition of high voltages on the web. This is performed by increasing the bias on the support rollers (such as 42 in FIG. 1 and detailed in the discussion above) to increase the voltage on the web. These rollers are also referred to as Paper Transfer Rollers (PTR). Good cleaning was obtained for all films under normal running conditions. The surface resistivity for all of the samples is greater than $1\times10^{14}$ ohm/sq for all the samples except the pseudo-boehmite alumina coating. The trend toward lower surface resistivity with increasing ZONYL FSN content is observed at high humidity for Examples 1-4, where Examples 1 and 2 have 3 and 6% of the fluorosurfactant respectively and surface resistivity greater that $2\times10^{14}$ ohm/sq, Example 3 with 9% fluorosurfactant showed a decrease of resistivity to $6\times10^{13}$ ohm/sq, and Example 4 with 12% fluorosurfactant had the lowest resistivity of $2\times10^{13}$ ohm/sq. The plot of the surface resistivity as a function of fluorosurfactant concentration is shown in FIG. 2.

The surface resistivity decreased logarithmically in this region of ZONYL FSN concentration, but did not fall below $10^{13}$ ohm/sq. The optimum cleaning was obtained in Example 3, where the coated transport web with 9 parts (7.83 wt %) of ZONYL FSN had a surface resistivity of $6\times10^{13}$ ohm/sq.

TABLE 2

Cleaning Test at High Paper Transfer Roller (PTR) Settings

| Example | Parts ZONYL or Siloxane | PPC1 | PPC2 |
|---|---|---|---|
| 1 | 3 parts ZONYL FSN (2.75 wt % ZONYL FSN) | good cleaning | poor cleaning of K + M |
| 2 | 6 parts ZONYL FSN (5.36 wt % ZONYL FSN) | poor cleaning of 2$^{nd}$ K patch | poor cleaning of 2$^{nd}$ K patch |
| 3 | 9 parts ZONYL FSN (7.83 wt % ZONYL FSN) | good cleaning | good cleaning |
| 4 | 12 parts ZONYL FSN (10.17 wt % ZONYL FSN) | good cleaning | poor cleaning of K |
| Comparative 4 | 6 parts DMDMS | poor cleaning of K + M | poor cleaning of K + M |
| Comparative 5 | 6 parts BYK333 | poor cleaning of K + M | No data |
| Comparative 6 | 3 parts DMDMS/ 6 parts ZONYL FSN | poor cleaning of 1 Magenta | poor cleaning of all Magenta |
| Comparative 7 | 3 parts BYK333/ 6 parts ZONYL FSN | poor cleaning of K + M | No data |

Example 5

9 Parts ZONYL FSN

The formulation was prepared as described above for Example 3. Two layers of the formulations were coated one on top of the other to give twice the capacity for oil absorption.

The cleaning of this web in a NexPress Printer is compared with three other Transport Webs in Table 3. The NexPress Transport (Comparative Example 3) web made of PET showed good cleaning. However this web will not absorb oil and leaves undesirable image artifacts on two-sided prints. The pseudo-boehmite coated web (Comparative Example 1) has marginally low resistivity causing difficulties in paper tack down and thus problems with image registration at high

TABLE 1

Characterization of Oil Absorbing Layers

| Example | Thickness (μ) | Oil Capacity (mg/m$^2$) | Specific Capacity (mg/m$^2$/μ) | Surface Resistivity (73° F./26% RH) | Surface Resistivity (70° F./60% RH) |
|---|---|---|---|---|---|
| Comp Ex 1 | 20.0 | 4870 | 243.5 | 1.26E+11 | 3.26E+10 |
| Comp Ex 2 | 8.5 | 4260 | 501.8 | 1.55E+16 | 7.89E+14 |
| Comp Ex 3 | 0 | 0 | 0 | 1.00E+15 | 1.00E+15 |
| 1 | 4.87 | 3060 | 628.9 | 3.08E+16 | 1.86E+14 |
| 2 | 4.33 | 2860 | 661.2 | 1.72E+17 | 1.37E+14 |
| 3 | 5.41 | 2610 | 482.8 | 4.26E+15 | 6.19E+13 |
| 4 | 4.33 | 2760 | 638.1 | 5.46E+14 | 2.36E+13 |
| Comp Ex 4 | 6.49 | 3180 | 490.3 | 7.26E+16 | 5.12E+14 |
| Comp Ex 5 | 5.68 | 2770 | 487.9 | 6.20E+16 | 2.01E+14 |
| Comp Ex 6 | 5.13 | 2960 | 576.5 | 4.06E+16 | 2.41E+14 |
| Comp Ex 7 | 5.93 | 2390 | 402.9 | 5.04E+15 | 1.31E+14 |
| 5 | 11.08 | 4930 | 444.9 | 1.54E+14 | 4.89E+13 |
| 6 | 5.95 | 2960 | 497.5 | 1.10E+17 | 1.10E+14 |
| 7 | 6.49 | 3470 | 534.7 | 9.17E+16 | 5.68E+14 |
| 8 | 6.49 | 3370 | 519.3 | 5.46E+16 | 1.92E+14 |

humidity. The dimethoxydimethylsilane web (Comparative Example 2) had both good oil absorption and high resistivity, but left small amounts of toner on the web which could contaminate prints. Example 5 gave the best combination of properties with good oil absorption, adequate surface electrical resistivity, and good cleaning.

TABLE 3

Cleaning Performance of Transport Webs

| Comparative Ex 3 NexPress Web | Comparative Ex 1 Pseudo-boehmite Web | Comparative Ex 2 Dimethoxy-dimethylsilane Web | Example 5 9 parts ZONYL FSN Web |
|---|---|---|---|
| Good | Good | poor | good |

Example 6

ZONYL Overcoat on 90 Parts Gamma-Alumina/10 Parts Poly(Vinyl Butyral) Binder/6 Parts Silanol Terminated PDMS Gamma-alumina (400 g), 3 A alcohol (1000 g), and 2.0 mm zirconia beads (5000 g) were placed in a 1 gallon jar and roll milled for 48 hours at 90 RPM. The alumina was collected by filtering off the shot and rinsing with 3A-alcohol (1400 g) to give a 14.3% solids dispersion. This alumina dispersion (2800 g) was combined with four others into a 22 L 3-neck round bottom flask equipped with a mechanical stirrer by filtering though a 40 micron PALL filter to give a total of 13,910 g. Poly(vinyl butyral) BH-6 (2210 g of a 10 wt % solution in 3A-alcohol) was added with an addition funnel to give a formulation with 10 weight % poly(vinyl butyral). Silanol-terminated PDMS, DMS-S12 (132.6 g), was added at 6% by weight of the alumina and BH-6 solids to give a dispersion of 13.7% solids. The dispersion was Netsch milled for 25 minutes for each liter of solution for a total of 453 minutes, followed by filtration through a 10 micron PALL filter.

The solution was coated onto a PET support as described above to give a 6 micron thick coating. An overcoat of ZONYL FSN was coated at 0.5 microns aim thickness using a 2% solution made by diluting ZONYL FSN (10 g @40% active) with 3A alcohol (190 g).

Example 7

ZONYL-Alumina Overcoat

The same alumina base coat was used as in Example 6. The top coat solution was prepared by mixing the alumina dispersion used to coat the base coat (30 g), 175.5 g 3A alcohol, and ZONYL FSN (0.9 g@40% active). The aim thickness for the coating was 0.5 microns.

Example 8

ZONYL-Alumina Overcoat

The same alumina base coat was used as in Example 6. The top coat solution was prepared by mixing the alumina dispersion used to coat the base coat (30 g), 175.5 g 3A alcohol, and ZONYL FSN (4.19 g@40% active). The aim thickness for the coating was 0.5 microns.

Examples 6, 7, and 8 showed good cleaning. However Example 7 was not as good as Examples 6 and 8. The lesser cleaning performance of the Example 7 film corresponds to the lower level of ZONYL FSN that was used as a top coat. However, Table 1 shows the superior oil absorption amount and higher resistivity that results from having the lowest amount of fluorosurfactant.

Elimination of Oil Image Artifacts from Duplex Prints.

Example 6 was run in the NexPress 2100 printer for 8 cycles of duplex prints, the equivalent of 7480 tabloid duplex prints, which is equivalent to 29,900 A4 prints. The target image had heavy toner stripes as the pattern. No image artifact due to oil related streaks was observed. There was no indication of any increasing density non-uniformity on the flat fields. Subsequent oil absorption indicated the web could have run many more cycles. These are similar results obtained previously for the pseudo-boehmite coatings. As a reference, stripes start appearing on the flat fields after about 18 prints with the uncoated web, Comparative Example 3, while the pseudo-boehmite webs, Comparative Example 1, have been run to 15 k without any significant image artifact issues.

The invention has been described in detail with particular reference to certain preferred embodiments thereof, but it will be understood that variations and modifications can be effected within the spirit and scope of the invention.

The invention claimed is:

1. An electrostatographic reproduction apparatus comprising:

a primary imaging member for producing an electrostatic latent image;

a development station for applying toner particles to said latent image, thereby forming a developed toner image;

a fuser assembly for fixing said developed toner image to a receiver, thereby forming a fused toner image on said receiver; and a transport member for transporting said receiver to or from said fuser assembly, said transport member comprising a substrate bearing an oil-absorbing layer that comprises transparent siloxane coated gamma-alumina particles, dispersed in an organic binder, and a fluorosurfactant.

2. The electrostatographic reproduction apparatus of claim 1 wherein the fluorosurfactant is a water-soluble, ethoxylated nonionic fluorosurfactant.

3. The electrostatographic reproduction apparatus of claim 2, wherein the transport member has a surface resistivity equal to or greater than $5\times10^{12}$ ohm/sq at 70° F./60% RH.

4. The electrostatographic reproduction apparatus of claim 1, wherein said transparent siloxane coated gamma-alumina particles have an average dispersed particle size of less than 0.5 microns.

5. The electrostatographic reproduction apparatus of claim 1, wherein said transparent gamma-alumina particles have an average dispersed particle size of less than 0.3 microns.

6. The electrostatographic reproduction apparatus of claim 1, wherein said transparent siloxane coated gamma-alumina particles have an average dispersed particle size of about 0.25 microns.

7. The electrostatographic reproduction apparatus of claim 1, wherein said transparent siloxane coated gamma-alumina particles have a crystallite size of about 100 angstroms or less based x-ray line broadening analysis of the gamma alumina (440) peak.

8. The electrostatographic reproduction apparatus of claim 1, wherein said organic binder is selected from the group consisting of poly(vinyl alcohol) or a modification product thereof, cellulose derivatives, ether-substituted poly(phosphazenes), ether-substituted acrylates, ethylene oxide-vinyl alcohol copolymers, poly(vinyl butyral), poly(vinyl formal), polyoxazolines, aliphatic polyamides, poly(vinylpyrrolidone), and mixtures thereof.

9. The electrostatographic reproduction apparatus of claim 1, wherein said oil-absorbing layer comprises transparent siloxane coated gamma-alumina particles and poly(vinyl butyral) in a weight ratio of about 3:1 to about 20:1.

10. The electrostatographic reproduction apparatus of claim 1, wherein said substrate bearing oil-absorbing layer is selected from the group consisting of a continuous web, a drum, and a roller.

11. The electrostatographic reproduction apparatus of claim 1, wherein said oil-absorbing layer further comprises polydimethylsiloxane.

12. The electrostatographic reproduction apparatus of claim 1, wherein said oil-absorbing layer further comprises silanol terminated polydimethylsiloxane.

13. The electrostatographic reproduction apparatus of claim 1, wherein the transport member has a resistivity equal to or greater than $5\times10^{12}$ ohm/sq at 70° F./60% RH.

14. The electrostatographic reproduction apparatus of claim 1, wherein said development station comprises a plurality of separate developing devices to enable full color image reproduction.

15. The electrostatographic reproduction apparatus of claim 1, wherein said transport member is adapted for duplex printing.

16. The electrostatographic reproduction apparatus of claim 1, wherein said oil-absorbing layer further comprises a crosslinking agent.

17. The electrostatographic reproduction apparatus of claim 1, wherein said transport member comprises a polyethylene terephthalate.

18. The electrostatographic reproduction apparatus of claim 1, wherein the fluorosurfactant is an overcoat layer.

19. An electrostatographic reproduction apparatus comprising:

a primary imaging member for producing an electrostatic latent image;

a development station for applying toner particles to said latent image, thereby forming a developed toner image;

a fuser assembly for fixing said developed toner image to a receiver, thereby forming a fused toner image on said receiver; and a transport member for transporting said receiver to or from said fuser assembly, said transport member comprising a substrate bearing an oil-absorbing layer that comprises transparent siloxane coated gamma-alumina particles dispersed in an organic binder, and an fluorosurfactant wherein the transport member is transparent and has a surface resistivity equal to or greater than $5\times10^{12}$ ohm/sq at 70° F./60% RH.

20. The electrostatographic reproduction apparatus of claim 19, wherein the oil-absorbing layer includes the fluorosurfactant in an amount of from about 0.01 wt % to about 15 wt %.

* * * * *